US008579397B2

(12) United States Patent
Barss et al.

(10) Patent No.: US 8,579,397 B2
(45) Date of Patent: Nov. 12, 2013

(54) JET PERFORMANCE

(75) Inventors: Steven H. Barss, Wilmot Flat, NH (US); William R. Letendre, Jr., Etna, NH (US); Paul A. Hoisington, Hanover, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 950 days.

(21) Appl. No.: 12/204,890

(22) Filed: Sep. 5, 2008

(65) Prior Publication Data

US 2010/0060684 A1 Mar. 11, 2010

(51) Int. Cl.
*B41J 29/38* (2006.01)

(52) U.S. Cl.
USPC ..... 347/9; 347/10; 347/11; 347/12; 347/19

(58) Field of Classification Search
None
See application file for complete search history.

(56) References Cited

U.S. PATENT DOCUMENTS

| | | | | |
|---|---|---|---|---|
| 6,648,444 | B2 * | 11/2003 | Valero et al. | 347/19 |
| 7,909,426 | B2 * | 3/2011 | Kim | 347/19 |
| 2004/0100512 | A1 | 5/2004 | Codos | |
| 2005/0104921 | A1 | 5/2005 | Watanabe et al. | |
| 2006/0071957 | A1 * | 4/2006 | Shang et al. | 347/6 |
| 2007/0070109 | A1 | 3/2007 | White et al. | |

FOREIGN PATENT DOCUMENTS

| | | | |
|---|---|---|---|
| CN | 101085570 | B | 12/2007 |
| JP | 11-227172 | | 8/1999 |
| JP | 2006-142808 | | 6/2006 |
| JP | 2006-175775 | | 7/2006 |
| JP | 2007-90888 | | 4/2007 |
| JP | 2007-148180 | | 6/2007 |
| JP | 2007-205873 | | 8/2007 |
| WO | WO2005005153 | A1 | 1/2005 |
| WO | WO 2008/095077 | | 8/2008 |

OTHER PUBLICATIONS

International Search Report and Written Opinion from International Application No. PCT/US2009/054612 dated Apr. 12, 2010.
International Preliminary Report on Patentability from International Application No. PCT/US2009/054612 dated Apr. 12, 2010.
European Search Report in EP Application No. 09811966.2, dated Apr. 17, 2013, 4 pages.
Chinese Search Report for Application No. 200980143678.2, dated Apr. 15, 2013, 2 pages.
Japanese Office Action, with English Translation, Application No. 2011-526102, mailed Aug. 6, 2013, 6 pages.

* cited by examiner

*Primary Examiner* — Uyen Chau N Le
*Assistant Examiner* — Chad Smith
(74) *Attorney, Agent, or Firm* — Fish & Richardson P.C.

(57) ABSTRACT

Among other things, for ink jetting, a system includes a printhead including at least 25 jets and an imaging device to capture image information for all of the jets simultaneously, the captured image information being useful in analyzing a performance of each of the jets.

30 Claims, 8 Drawing Sheets

JET PERFORMANCE

TECHNICAL FIELD

This description relates to jet performance.

BACKGROUND

The quality of an image or a product formed on a substrate by ink jetted from an ink jet printer can be affected by the performance of jets in the printhead of the printer. The jets in some printheads are arranged in one or more rows, in a direction different from, e.g., perpendicular to, a process direction of the printer. Each jet includes a pumping chamber to receive and pump ink and a nozzle to jet ink from the pumping chamber to the substrate. By applying an activation voltages to a piezoelectric element associated with each pumping chamber ink droplets can be jetted based on information about the image to be printed.

Typically, the jets in each row are identical and each pair of neighboring jets along a row are separated by equal spaces. Each row of jets can be about 1 inch to about 3 inches long and can contain at least 25 jets or 50 jets and up to about 500 jets, for example. Each jetted ink droplet can have a size of about 2 picoliters to about 100 picoliters, based on dimensions of the jet and the voltages applied to the jet.

Generally, a jet is built for jetting one size of ink droplet in response to a particular activation voltage at a jetting frequency that is within a particular range. If the voltage varies or the jet is activated at a frequency outside the frequency range, the jet may perform poorly or even stop working. Sometimes a jet is built for jetting several different-sized ink droplets, each in response to a particular activation voltage and within a certain frequency range of jetting. Discussion of different types of printheads and jets is provided, for example, in U.S. Pat. No. 5,265,315, U.S. Pat. No. 7,052,117, U.S. Ser. No. 10/800,467, filed Mar. 15, 2004, U.S. Ser. No. 11/652,325, filed Jan. 11, 2007, and U.S. Ser. No. 12/125,648, filed May 22, 2008, all of which are incorporated here by reference.

Even when a jet is driven at the intended activation voltage and within the intended frequency range, the quality of the ink droplets (and the resulting printing) can be degraded by manufacturing flaws in, or a temporary malfunction of, the jet (air bubbles, or ink adhering to the nozzle, for example). Temporary malfunctions sometimes can be corrected.

The performance of a jet can be gauged in several ways. One technique analyzes quantifiable properties of ink droplets that it jets, for example, their size, speed, or trajectory. Another approach compares its performance to the performance of other jets in the row, for example, the response of the jet upon activation relative to the other jets or the speed of the jetted ink droplets relative to ink droplets jetted by the other jets. The performance can also be gauged by analyzing an image or product the jet prints, for example, information about whether a dot printed by the jet appears at an intended position with an intended size and shape on the substrate or whether a line printed by the jet is straight and has an intended thickness.

As shown in FIGS. 1A and 1B, in step-and-repeat printing, a printer 10 having one or more printheads 12 (not all shown) each containing one or more rows of jets 14 (not all shown) prints lines 16 on a substrate 18 that is stationary. The printhead 12 scans across a width of the substrate 18 along a rail 20 (process direction y) and prints lines 22 of successive dots that are parallel to the row of jets 14 (x direction). In this example, each line 22 corresponds to one jet 14 in the row of jets and the density of the lines 22 along the x direction depends on the density of jets 14 in the row. The substrate 18 then moves a step along the x direction and the printhead 12 repeats the printing process across the substrate 18.

Referring to FIG. 1B, in single pass printing, a stationary printer 24 having one or more printheads 34 (not all shown) each containing one or more rows of jets 28 (not all shown) covers a width of an image that is intended to be printed on a substrate 26 (x direction) and prints lines 30 continuously. The printer 24 prints successive rows of dots 32 parallel to the row of jets (x direction) when the substrate 26 passes under the jets 28 along the process direction y.

SUMMARY

In one aspect, for ink jetting, a system includes a printhead including at least 25 jets and an imaging device to capture image information for all of the jets simultaneously, the captured image information being useful in analyzing a performance of each of the jets.

Implementations may include one or more of the following features. The printhead includes at least 100 jets. The printhead includes at least 200 jets. The imaging device comprises a linescan camera. The imaging device comprises linearly arranged pixels, each pixel having a resolution of about 2 μm to about 10 μm. The imaging device comprises about 2000 pixels to about 12000 pixels. The imaging device takes images at a maximum frequency of at least about 5 KHz. The imaging device transfers image information at a rate of about 30 mega-pixels/second to about 50 mega-pixels/second. The system also includes a substrate onto which jets jet ink droplets and the image information is captured in a region between the jets and the substrate as the jetted ink droplets pass the region. The performance of each of the jets comprises at least one of a velocity of a droplet jetted from a corresponding jet, a size of the droplet, a shape of the droplet, a trajectory of the droplet, and distance between the droplet and its neighboring droplet perpendicular to a jetting direction. The imaging device is located about 50 mm to about 200 mm from the trajectory of droplets jetted from the jets. The system also includes a substrate onto which each jet jets ink droplets to print a line on the substrate, and the image information is of the printed line. The performance of the jets comprises straightness of the line and thickness of the line. The imaging device is located about 50 mm to about 200 mm from the substrate. The imaging device is stationary relative to the printhead. At least some of the jets are arranged in a row. The system also includes a device for processing images produced by the imaging device and evaluating the performance of the jets. The system also includes a control to automatically adjust an aspect of the printhead based on the performance of the jets during ink jetting.

In another aspect, for use in jetting ink, a method includes generating an image of a composite droplet based on at least two image portions that respectively capture image information for portions of ink droplets that are jetted from the ink jet at successive time periods, each time period being the period of the capturing of the image information.

Implementations may include one or more of the following features. The droplets are successive droplets jetted from the jet. The image portions are generated at an imaging frequency different from a jetting frequency of the jet. The image portions of the droplets are composited along a jetting direction of the jet. The method also includes measuring the performance of the jet by calculating a velocity of the ink droplets based on the image of the composite droplet. The method also includes generating additional images of additional composite droplets and measuring the performance of the jet by calculating a trajectory of the ink droplets based on the image of the composite droplet and the additional images of the additional composite droplets. The method also includes adjusting an aspect of the jet based on the measured performance of the jet. The jet is included in a printhead having more than 25 jets and the method also includes simultaneously generating an image of a composite droplet based on at least two image portions that respectively capture image information for portions of ink droplets jetted from each jet. Each image slice has a resolution of about 2 μm to about 10 μm.

In another aspect, for use in measuring performance of jets in a printhead containing at least 25 jets, a method comprises capturing image information for all of the jets simultaneously for use in analyzing a performance of each of the jets.

Implementations may include one or more of the following features. The capturing includes imaging ink droplets jetted from each jet simultaneously. The capturing is done using a linescan camera. The linescan camera comprises about 2000 to about 12000 linearly arranged pixels and each pixel includes a resolution of about 2 μm to about 10 μm. The method also includes delivering image information at a rate of about 30 mega-pixel/second to about 50 mega-pixel/second. The jets are arranged in a row and the capturing is done at a frequency different than a frequency at which the row jets jet the ink droplets. The capturing also includes compositing the image information in time sequence along a jetting direction of the jets. The method also includes sending a feedback to the printhead based on the capturing and adjusting an aspect of the printhead based on the feedback. The jets jet ink droplets onto a substrate to form a first image and the capturing includes producing a second image based on the first image. The producing includes scanning the first image using a linescan camera. The linescan camera scans the first image during the formation of the first image. The first image comprises lines and analyzing the performance of each of the jets includes analyzing straightness or a width of each line based on the second image.

In another aspect, for use in jetting ink from an ink jet, a method comprises capturing images of portions of less than all of respective droplets that are jetted from the ink jet at successive time periods, each time period being the period of the capturing and using the captured images to infer information about characteristics of each of the droplets that is jetted from the ink jet. The portion can be about 1/10 to about 1/2.

These and other aspects and features, and combinations of them, can be expressed as methods, apparatus, systems, means for performing a function, and in other ways.

Other features and advantages will be apparent from the following detailed description, and from the claims.

DETAILED DESCRIPTION

Performance of the jets can be measured, analyzed, evaluated, and ameliorated by a system described here, both for a step-and-repeat printer or a single pass printer. The actions can be taken either during design or manufacture and before the jets are put into operation, and can be done quickly enough to be performed between executions of printing jobs. In some cases it may be possible to perform them continuously on the fly during a printing job. As a result, the design, manufacture, maintenance, and operation of the ink jets (and the quality of the images printed) can be improved.

Figure 1A:
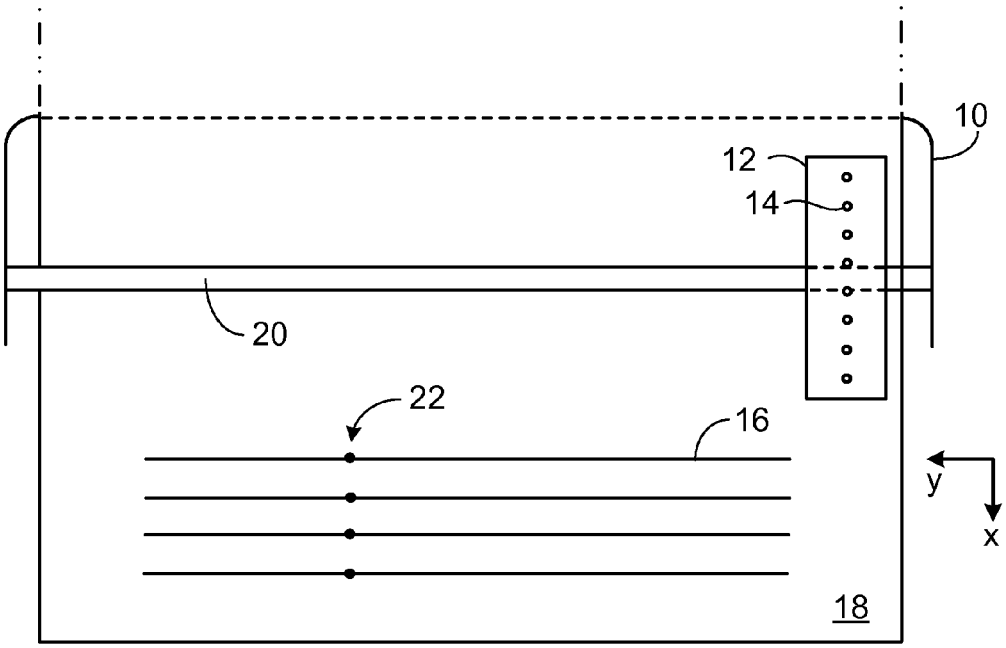
FIGS. 1A and 1B are schematic top views of printers (not to scale).
Figure 1B:
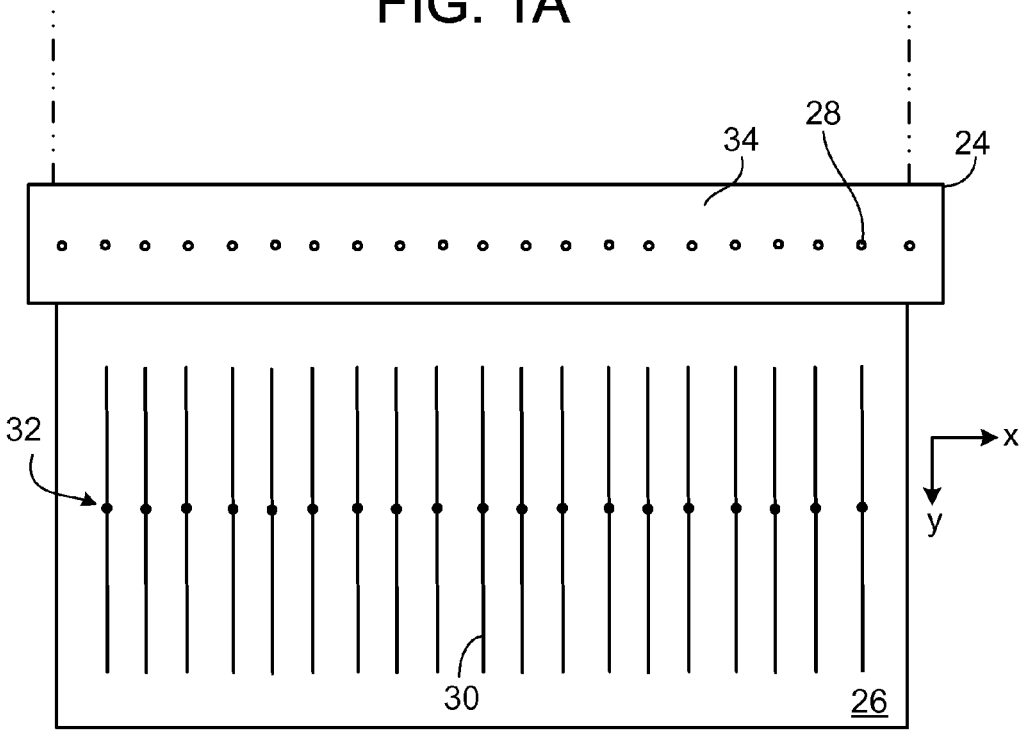
Figure 2:
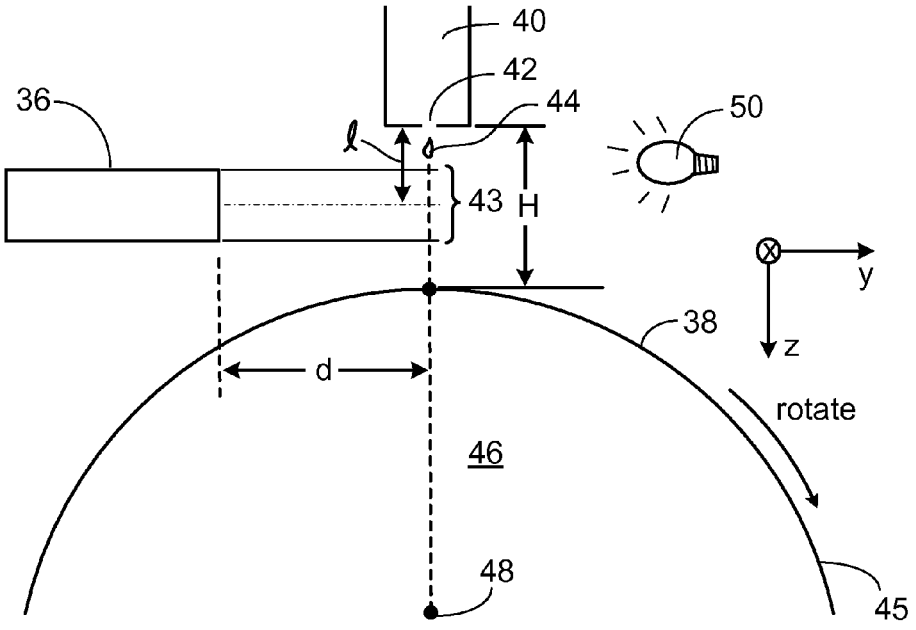
FIGS. 2 and 2A are a schematic side view and a schematic front view of a system for jet performance measurements (not to scale).

Referring to FIG. 2, in some examples, a linescan camera 36 captures images of ink droplets 44 jetted from a printhead 40 (such as the printhead 12 or 34 of FIG. 1A or 1B) and the performance of the jets 42 in the printhead 40 is determined from the image information. In this example, the printhead 40 and a substrate 38 are arranged similarly to the arrangement of the printhead 34 and the substrate 26 of FIG. 1B. Here, for purposes of performance measurements, the substrate 38 is a surface 45 of a drum 46 rotating about a longitudinal axis 48 parallel to the x direction. The jets 42 are in a row parallel to and above the longitudinal axis 48 and are a distance H (for example, about 1 mm to about 20 mm or about 1 mm to about 10 mm) above the substrate 38. The surface 45 can be a material that does not absorb ink, for example, a metal, so that the ink jetted onto the substrate 38 can be cleaned, for example, wiped, and t reused. Other substrates, for example, a roll-to-roll web, can also be used.

The linescan camera 36 focuses on a region 43 vertically below the jets 42, through which the jetted droplets 44 pass, to take images of the droplets 44 in mid-air. The linescan camera 36 is placed at a horizontal distance d from a line between the jets and the axis 48 and a vertical distance l below the jets 42, such that the droplets can be imaged in focus by the camera. The distance d is, for example, at least about 40 mm, 50 mm, 60 mm, 70 mm, or 80 mm, and/or up to about 200 mm, 180 mm, 150 mm, 130 mm, or 100 mm and the distance l is, for example, about 1 mm to about 5 mm, which is similar to a distance between the jets 42 and a substrate when the jets 42 are in use in a printer. In some embodiments, a lens (not shown) can be placed in front of the linescan camera 36 to form an in-focus image of the droplets, and a light source 50 can be placed, for example, at the opposite of the camera 36 to light the region 43 to aid imaging of the ink droplets.

Figure 2A:
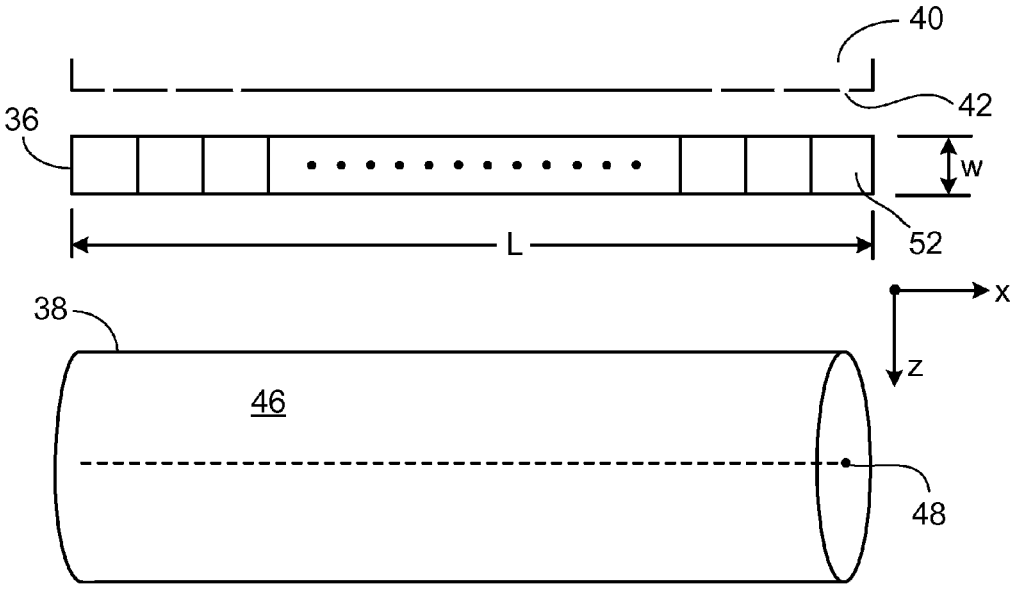

Referring to FIG. 2A, the linescan camera 36 can take high-resolution images each capturing all of the ink droplets 44 jetted from all jets 42 of printhead 40 at a given moment and repeat the capturing of successive images at a high frequency. The linescan camera 36 includes about 2000 to about 12000 pixels 52 arranged linearly and in parallel with the row of jets 42. Each pixel 52 has a resolution of about 2 μm to about 10 μm. In the example shown in the figure, the linescan camera 36 can take an image having a length L up to about 12 cm and a width w up to about 10 μm at a maximum resolution of each pixel, and simultaneously capturing all ink droplets from all jets 42 that are passing the camera. Multiple images can be taken successively at a maximum frequency $f_i$, for example, of at least 5 KHz, 6 KHz, 7 KHz, or 8 KHz, and/or up to about 12 KHz, 11 KHz, or 10 KHz and image information can be delivered at a rate of about 30 mega-pixels/second to about 50 mega-pixels/second, for example, 40 mega-pixels/second (eight bits or one byte of information for each pixel). Information about characteristics of the droplets 44 can be extracted from the image information and the jet performance measurements for the printhead 40 can be done within a short period of time, for example, seconds, and information about the performance of an individual jet relative to the other jets can also be obtained. The linescan camera 36 can be a P/N P2-23-08k40 camera available from Dalsa Corp (Waterloo, Canada).

During the jet performance measurements, all jets 42 are activated by selected voltages delivered at a maximum jetting frequency $f_j$ to print a row of dots 32 (FIG. 1B). The maximum jetting frequency $f_j$ is about 2 KHz to about 100 KHz or even more, for example, about 5 KHz to about 10 KHz. The voltage applied to the pumping chamber of each jet is about 10 V to about 100 V, for example, about 20 V to about 80 V, and can generate droplets that move to the substrate at different speeds, for example, about 2 m/s to about 20 m/s. In some embodiments, different jets 42 can be activated by different voltages or at frequencies lower than the maximum frequency $f_j$. Patterns other than continuous lines 30 can be formed on the substrate 38.

Figure 2B:
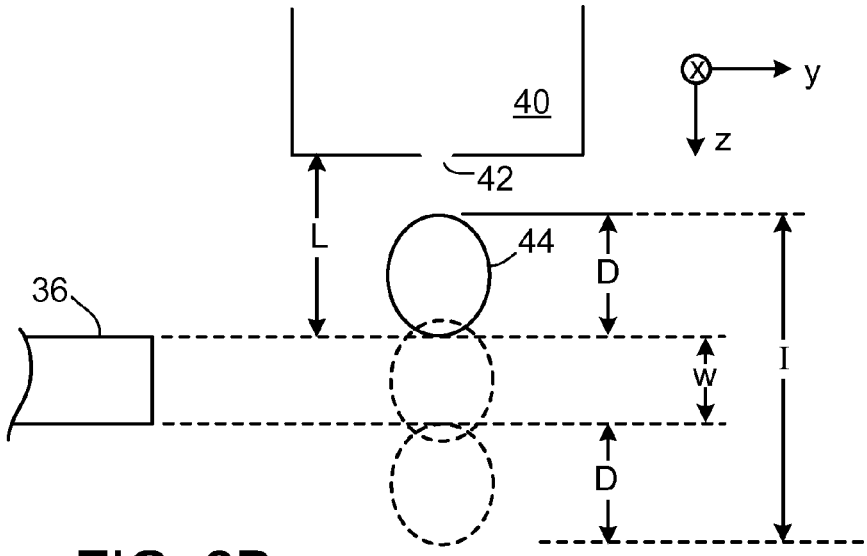
FIG. 2B is an enlarged schematic side view of a portion of the system of FIG. 2 (not to scale).

Referring to FIG. 2B, the linescan camera 36 has an imaging range I along a jetting direction z. When an ink droplet 44 is anywhere within the imaging range, at least some part of the droplet can be captured in an image the linescan camera 36 takes. The imaging range I is about two times the diameter D of each droplet 44 and the width w (assuming the droplet is substantially round. Droplets can have other shapes, for example, round droplets with long tails). As explained above, each droplet 44 is about 1 picoliter to about 100 picoliters or more, so the diameter D of each droplet 44 is about 10 μm and/or up to about 50 μm or more and is larger than the imaging width w of the linescan camera 36. Accordingly, when a droplet 44 passes the imaging range I of the linescan camera 36 and the linescan camera is taking an image, only a portion, for example, about 1/10 or less to about ½ or more, of the droplet 44 is captured in the image. The imaging range I can vary based on the shape of the droplets 44.

The imaging frequency $f_i$ of linescan camera 36 can be $nf_j$ or $(1/n)f_j$, where n is a positive integer and $f_j$ is the jetting frequency of the row of jets 42. The velocity of the droplets 44 and a vertical distance L between the linescan camera 36 and the jets 42 can be adjusted so that at least a portion of one droplet 44 from one jet 42 can be captured in an image 56 in the form of an image slice. By successively capturing images of successive or non-successive droplets jetted from a jet, image slices 56 are produced and can be "stacked" along the jetting direction z.

Figure 2C:
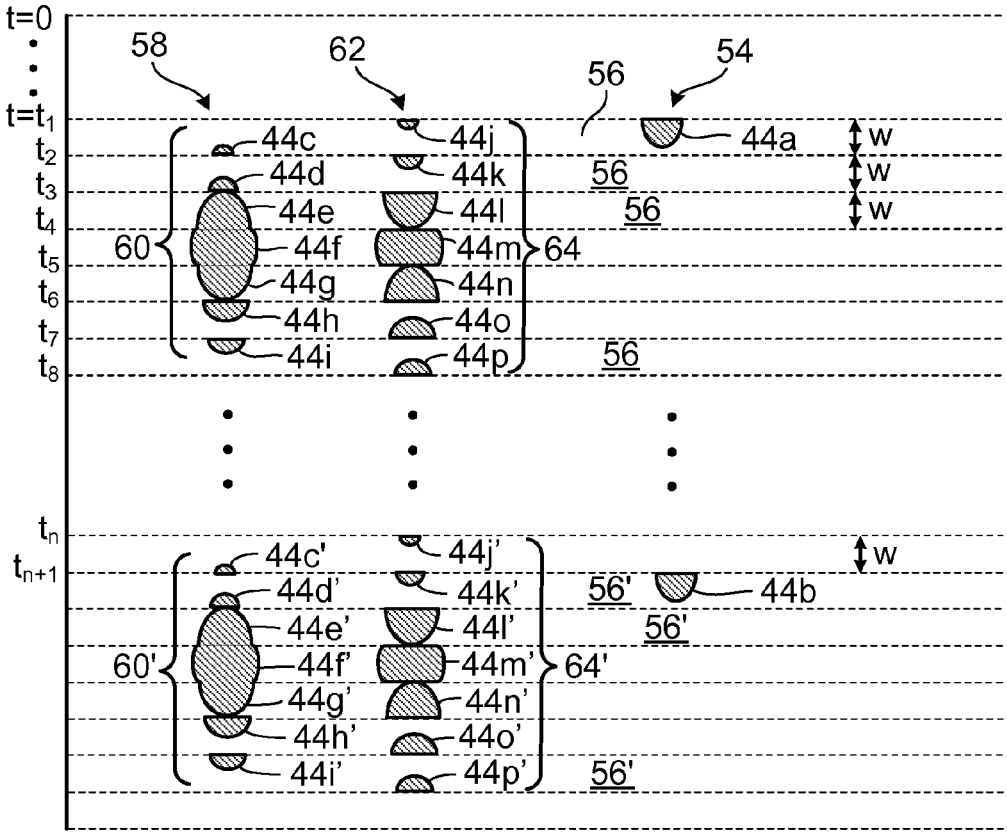
FIG. 2C is a schematic view of image slices.

For example, the imaged droplets 44 from one particular jet are shown as a composite of stacked slices 56 in image 54 in FIG. 2C. A portion of the first droplet 44*a* is imaged at time $t_1$ and the same portion of another droplet 44*b* from the same jet is imaged at $t_{n+1}$, where $t_{n+1}-t_1$ is n times the period between successive imaging or the period between successive jetting. In this approach (the imaging frequency $f_i$ being n times or 1/n fraction of the jetting frequency $f_j$ (not shown in FIG. 2C)), the imaged small portions of the droplets 44 on each image slice 56 may be of only modest value in analyzing the jet performance. In addition, droplets from some of the jets 42 can be missed in the images because of the response delay of those jets relative to the jets being properly imaged or velocity differences of the ink droplets 44 from different jets.

The imaging frequency $f_i$ of linescan camera 36 can be smaller than $2f_j$ but different from $(1/n)f_j$. A time difference ΔT between the imaging period $T_i$ (which is the inverse of the imaging frequency) of the linescan camera 36 and multiples of the jetting period $nT_j$ ($T_j$ being the inverse of the jetting frequency of the row of jets 42) can be introduced to produce multiple image slices 56 that can be assembled into an image of a composite droplet. The image of the composite droplet is not an image of a single droplet but rather how the droplet 44 would be characterized based on an assumption that drops jetted from a single jet using a given activation voltage and at a constant jetting frequency will tend to have the same characteristics. The time difference ΔT can be selected to be a fraction, for example, ½, ¼, 1/10, or other fractions, of l/(velocity of the droplet). The linescan camera 32 can start imaging simultaneously with the activation of the row of jets 42 to jet a first droplet from each jet at time zero and after $mT_i$, a portion of a droplet 44 is captured in the $(m+1)^{th}$ image slice, where m=0, 1, 2, . . . .

When $T_i$ is smaller than $kT_j$ but larger than $(k-½)T_j$, where k=1, 2, . . . , for example, $T_i$ is 198 μs, $T_j$ is 200 μs, and ΔT is 2 μs, a portion of the first droplet 44*c* from one jet is captured in image slice 56 taken at $t_1$ shown in image 58 of FIG. 2C. Subsequently, when the linescan camera 36 takes an image at $t_2$ that is one period $T_i$ after $t_1$, a second droplet 44*d* from the same jet is passing the image range but located (2 μs×velocity of the droplet 44*d*) vertically above the position of the first droplet 44*c* at which it was imaged relative to the imaging range. Similarly, different portions of successive droplets 44*e*-44*i* are captured by successive image slices due to the time difference ΔT. When these image slices are stacked along the jetting direction z, the portions of droplets 44*c*-44*i* generate one large composite droplet 60. Assuming that each jet 42 jets droplets having substantially identical characteristics, the composite droplet 60 can be a good representative of the characteristics of each of the droplets 44*c*-44*i*. A size and shape of each droplet can be calculated from the image of the composite droplet 60. In other examples when k is larger than 1, composite droplets like the composite droplet 60 can also be generated using successive image slices like the image slices 56, but each successive image slice 56 capturing one of non-successive droplets (separated at least by time $(k-1)T_j$) jetted from the jet.

The velocity of a droplet from the jet 42 can be calculated by dividing the vertical distance L by the time the droplet flies from the jet 42 into the imaging range I, which can be derived from the image information of the stacked image slices of FIG. 2C. For example, when the linescan camera 36 and the jets 42 are so adjusted that at any moment, there is at most one droplet 44 from each jet 42 flying within the vertical distance between the jets 42 and the camera 36, then using the image 58 of FIG. 2C, the velocity of the droplets from on particular jet 42 can be calculated to be $L/(\Delta T\times(t_1/T_i-1))$. Generally, conditions for such an arrangement are satisfied when $T_j$ is larger than the total flying time of a droplet from the jets 42 to the substrate 38, or when the droplet velocity is high and the jetting frequency is low. In situations when more than one droplets are flying between the jets 42 and the substrate 38 (FIG. 2), velocities of the droplets can be obtained by processing the calculated values from $L/(\Delta T\times(t_1/T_i-1))$. For example, a calculated value for each jet 42 can be filtered, e.g., to limit the values to be between a reasonable range, such as about 2 m/s to about 20 m/s, or averaging multiple, filtered calculated values from more than one composite droplets, e.g., about 10 composite droplets. Other algorithms can be used to calculate the droplet velocities based on the images of the composite droplets. The obtained droplet velocity for each jet can have a high precision, for example, within 1% range of variation.

When $T_i$ is larger than $kT_j$ but smaller than $(k+½)T_j$, where k=1, 2, 3, . . . , an image 62 of a composite droplet 64 can be produced in a similar way as the image 58 of the composite droplet 60 (composite droplets 60 and 64 and droplets 44*a* and 44*b* are independent of each other; they are shown in the same figure and within similar time ranges only for illustrative purposes), except that the each droplet in successive or non-successive droplets 44*j*-44*p* is located (2 μs×velocity of the droplet 44*b*) below the position of a directly previous droplet relative to the imaging range I at the moment when an image of each droplet is taken. Based on the same assumptions, the velocity, size, and shape of the droplets represented by the composite droplet 64 can be calculated.

The total number of image slices 56 used to generate the image 58 or 62 of composite droplet 60 or 64 can be selected by choosing a suitable time difference ΔT. Each droplet passes the image range of the linescan camera 36 in a time period of about (2D+w)/(velocity of the droplet). To capture q successive or non-successive droplets in q successive image slices to generate a composite droplet, the time difference ΔT can be selected to be (2D+w)/(velocity of the droplet×q). Prior to the performance measurement of the jets, the velocity of the droplet can be an estimation.

After capturing the final droplet 44*i* or 44*p* of successive or non-successive droplets 44*c*-44*i* or 44*j*-44*p* passing the imaging range I of the linescan camera 36, one or more subsequent droplets can pass the imaging range without being imaged, until at time $t_n$, a portion of a droplet 44*c*' or $\mathbf{44}_j$' is captured in an image slice. Portions of subsequent droplets 44*d*'-44*i*' or 44*k*'-44*p*' can be captured in image slices 56' and images of composite droplet 60' and 64' can be produced. The images of the composite droplets 60 and 60' or 64 and 64' (or more composite droplets) generated from droplets jetted from a given jet can be used to measure a trajectory of a droplet from that jet. The trajectory measurement can have a high precision, for example, in the order of one milliradian.

Figure 3:
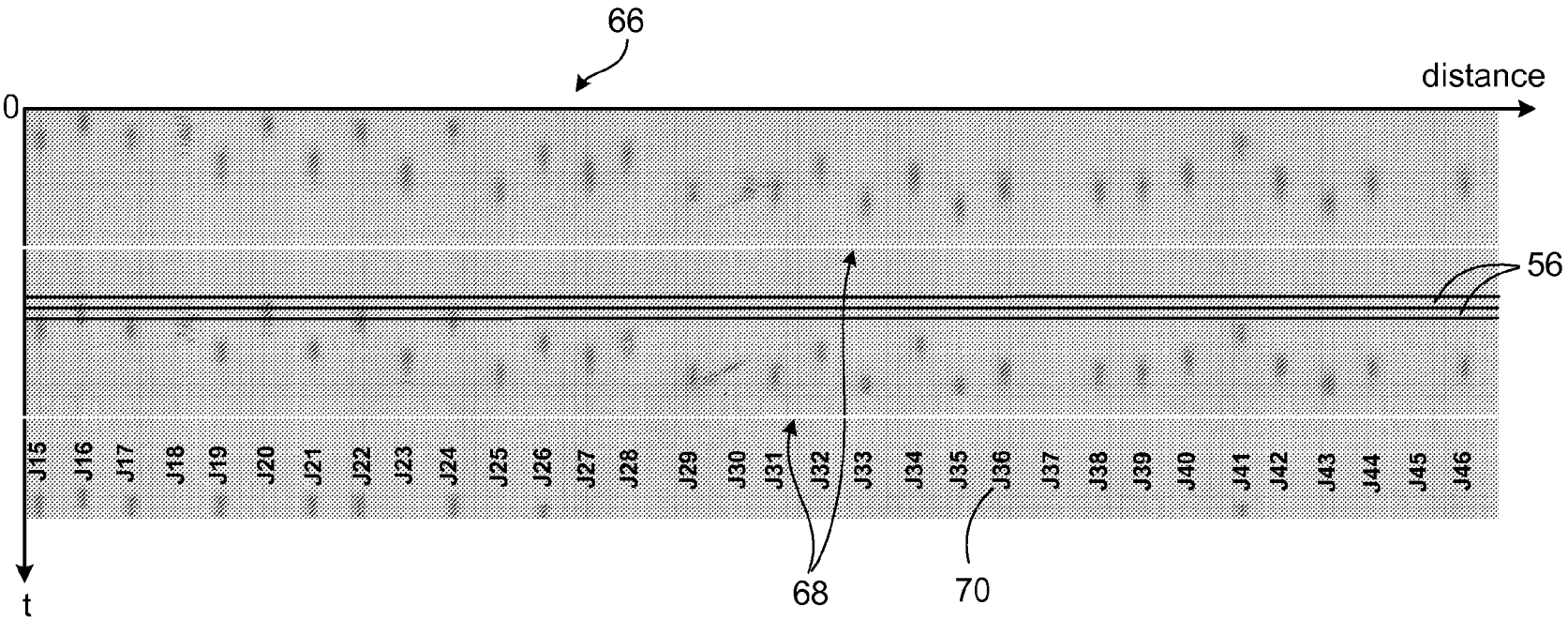
FIGS. 3, 3B and 3C are photographs.

Referring to FIG. 3, an image portion 66 made of the stacked image slices 56 (exemplary, size not to scale) covering a width of 32 jets (horizontal axis, jets number 15-46) of the printhead 40 is intercepted from full width, stacked image slices that cover a width of all jets 42, e.g., 256 jets, of the printhead 40 and is enlarged for view and analysis. The jetting frequency of the row of jets 42 is about 5 KHz. For each of most jets shown in the figures, images of 2 to 3 composite droplets are generated, each from about 12 image slices 56 or 12 droplets. The image representing the droplets from all jets in the printhead can be formed rapidly, for example, 100 image slices 56 can be captured in about 20 milliseconds. Post imaging process, for example, filtering to sharpen the images, placing straightness reference lines 68, and/or placing jet IDs 70, can be done to facilitate the analysis of the image portion 66 and evaluation of the jet performance of the printhead 40.

Information about jet performance in the printhead 40, other than the velocity, size, and shape, of the jetted droplets as described above, can be obtained from the image portion 66. For example, weak and unstable jets J18 and J30 and missing jets J37 and J45 are identified. The response upon activation and velocities of the jetted droplets, for example, of jets J16 and J20, are different from those, for example, of jets J32 and J36. In addition, the distance between different pairs of droplets jetted from neighboring jets, indicating the distance between pairs of corresponding jets, are not all the same. For example, droplets jetted from jet J27 are closer to droplets jetted from J26 than to droplets jetted from J28. Other useful information about the performance of the jets can also be extracted from the image portion 66. The information from the jet performance measurements can be used in designing, manufacturing, maintaining, and application of the printhead 40.

Multiple images like the image portion 66 can be produced, each measuring the performance of the jets in the printhead 40 at a selected jetting frequency and droplet velocity (selected by choosing a voltage that is applied to the jets) to identify a range of jetting frequency and droplet velocity for which high quality performance is achieved, or to determine whether the jets demonstrate high quality performance within an intended range of jetting frequency and droplet velocity as designed. For example, referring to FIG. 3A, each grid 76 represents one jetting frequency in the range of 5 KHz and 200 KHz and one droplet velocity in the range of 2 m/s and 20 m/s. The low quality performance of a jet when activated by a high voltage and jetting droplets with a high speed can be identified, for example, in an image portion 78 of FIG. 3B, in which droplets, for example, composite droplets 80 and 82, have long tails 84 and 86. One image like image portion 66 can be produced for each grid 76 of FIG. 3A for the printhead 40 and an optimal performance range 74, for example, 10 KHz to 25 KHz and 12 m/s to 18 m/s, for all jets in the printhead can be identified.

In some embodiments, the performance of the jets is measured when different activation voltages are applied to different jets. For example, an image portion 88 of FIG. 3C shows composite droplets 90 having a high velocity and jetted from odd numbered jets each activated by a high voltage and composite droplets 92 having a low velocity and jetted from even numbered jets each activated by a low voltage. Composite droplets 90 have longer tails than composite droplets 92. The high and low voltages applied to the two sets of jets can be adjusted independently to find an optimal range of activation voltages (therefore, droplet velocities), within which all jets to perform with high quality.

Instead of monitoring ink droplets jetted from the jets to measure the performance of the jets as described above, jet performance can also be measured by monitoring an output, e.g., an image, formed on a substrate by the jetted ink droplets. In some embodiments, jet performance can be measured by monitoring both the ink droplets in air and the output formed by the output simultaneously.

Figure 4A:
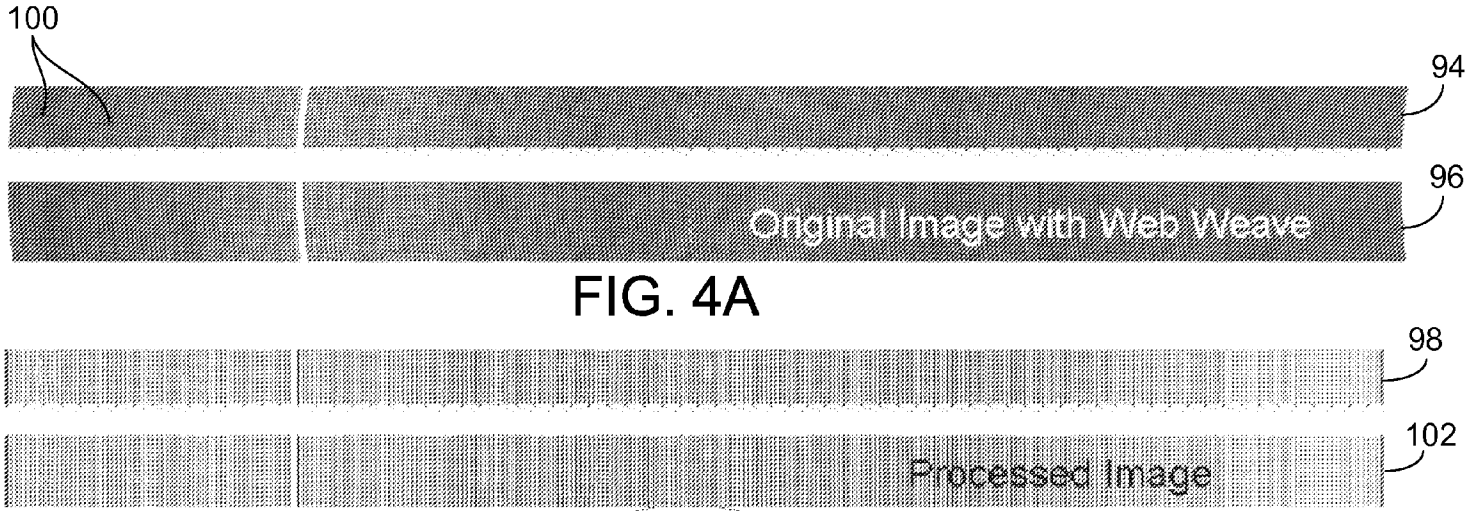
FIGS. 4A and 4B are photographs.

Referring to FIG. 4A, an image 94 containing parallel lines 100 is formed on a substrate, for example, paper, using the ink jet printer 10 of FIG. 1A or ink jet printer 24 of FIG. 1B when each jet 14 or 28 is activated to jet ink droplets at a jetting frequency of each row of the jets. An image 96 maintaining a resolution of the image 94 and magnifying the features of each line 100 is generated using the linescan camera 36 as described previously. In particular, the linescan camera 36 placed about 50 mm to about 100 mm above the image 94 scans the image 94 along a direction parallel to the lines 100 and produces successive image slices (not shown) that are stacked along the scanning direction of the camera. The image 96 can be used for analyzing straightness and/or line width of each line 100. To facilitate such an analysis, it is desirable that the image 96 does not include interferences, for example, textures of the paper substrate on which the lines 100 are formed.

Figure 4B:
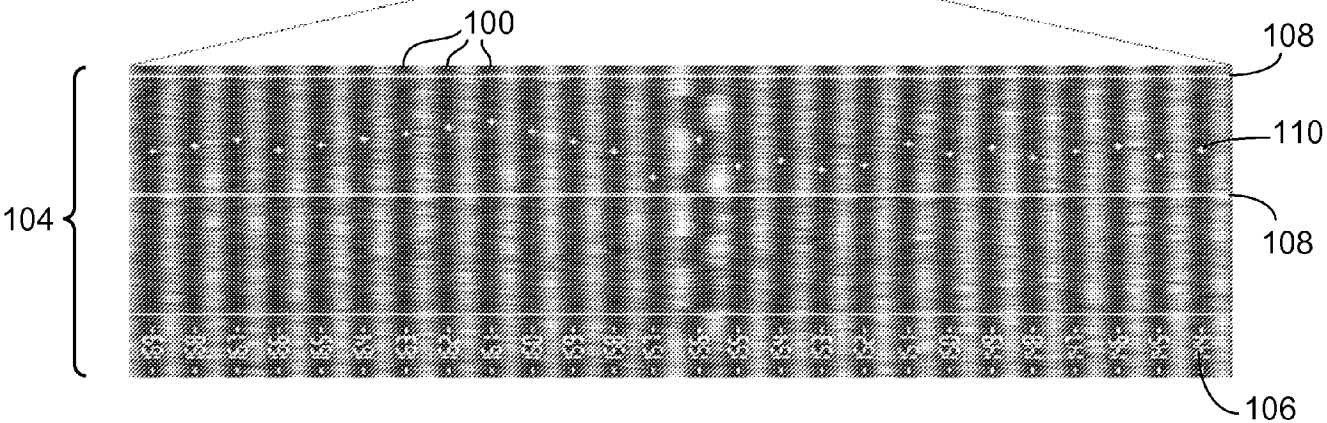

Referring to FIG. 4B, an image 102 is generated using the linescan camera 36 in a manner similar to the generation of image 96 based on a processed, e.g., filtered, image 98 of the image 94. Similar to the image portion 66 of FIG. 3, the image 102 is also processed to include jet IDs 106 and straightness reference lines 108 to assist the analysis of the image. A sample portion 104 of the processed image 102 shows lines 100 printed by jets having IDs from 144 to 169. Quality, e.g., the straightness and the width, of each printed line is rated using crosses ("+") 110: the closer the cross 100 is to the center reference line 108, the straighter the printed line 110 is, and therefore, the higher quality performance the corresponding jet demonstrates. For example, the line printed by jet 156 shows poor straightness and has a cross 110 located vertically high above the center reference line 108 to indicate poor performance of the jet 156.

Figure 3A:
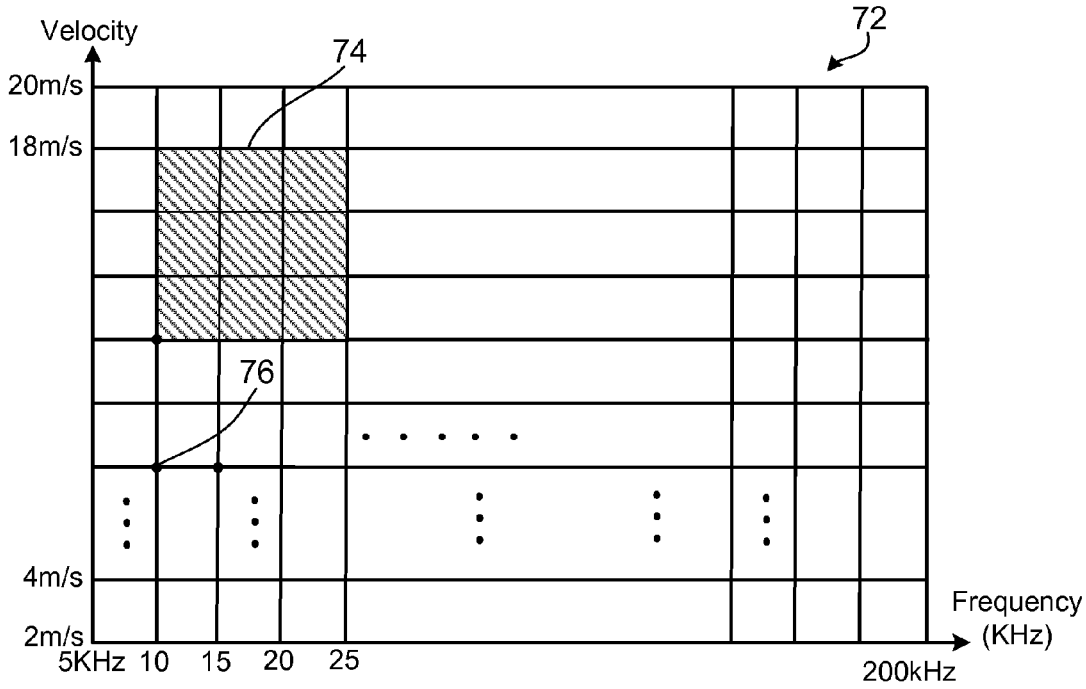
FIG. 3A is a grid of a jetting frequency range and a droplet velocity range.
Figure 3B:
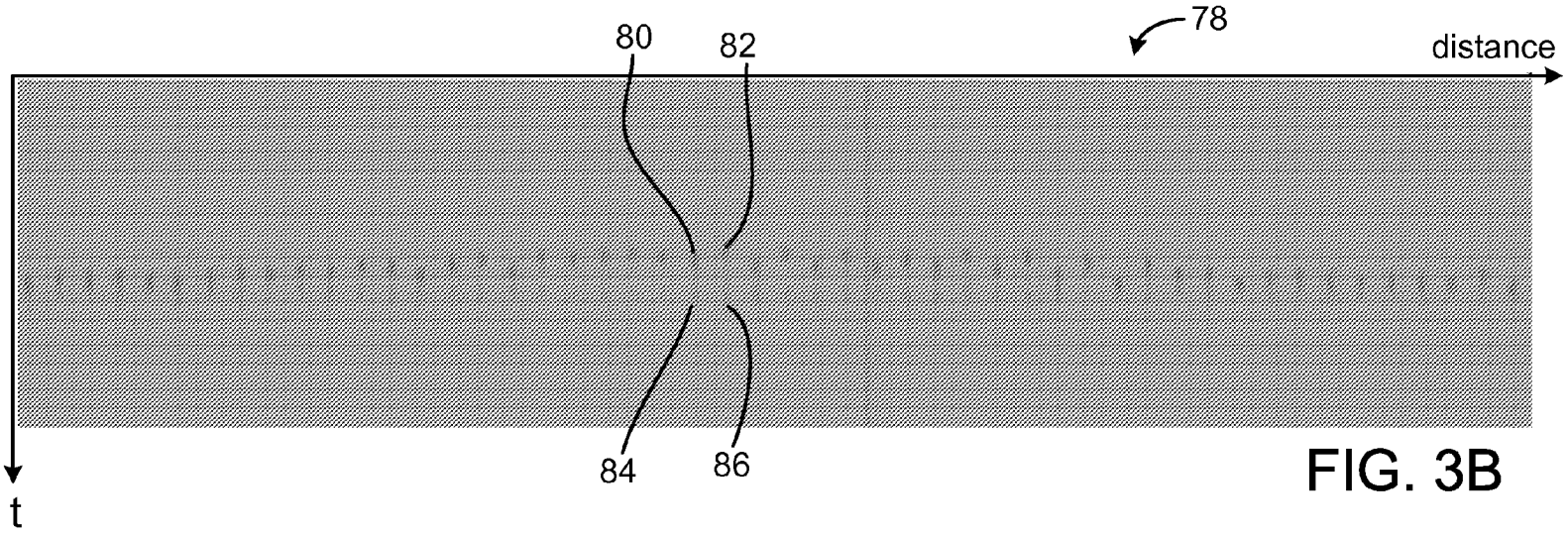
Figure 3C:
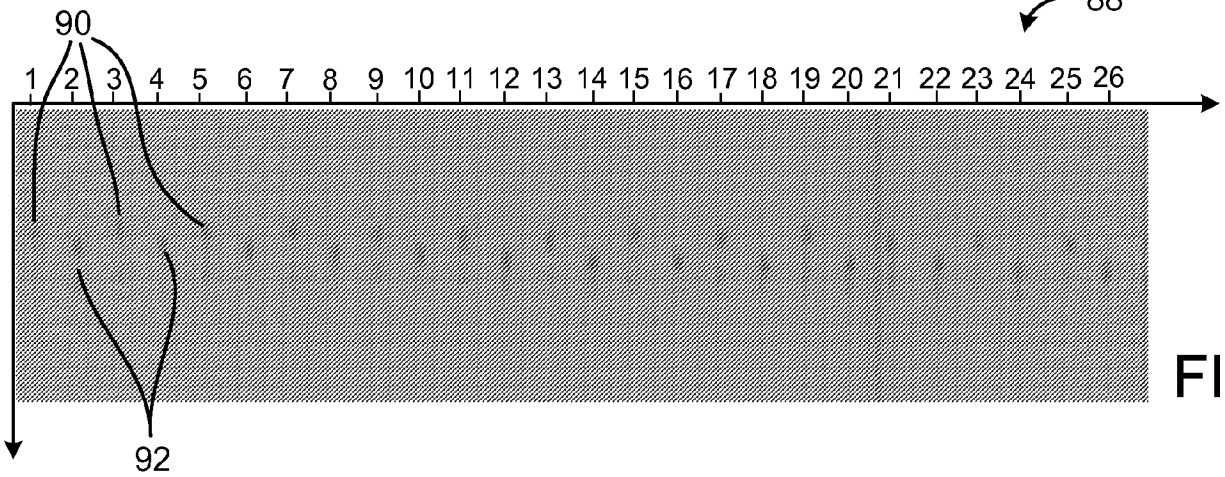

The monitoring of the output formed by the jets can also be used in studying the optimal ranges for jetting frequency and droplet velocity of a printhead similar to the application of the linescan camera 36 in the droplet monitoring at different jetting frequencies and droplet velocities discussed with respect to FIG. 3A. The use of the linescan camera 36 in the monitoring of the output allows fast and simultaneous analysis of the performance of each jet in a printhead.

Figure 5A:
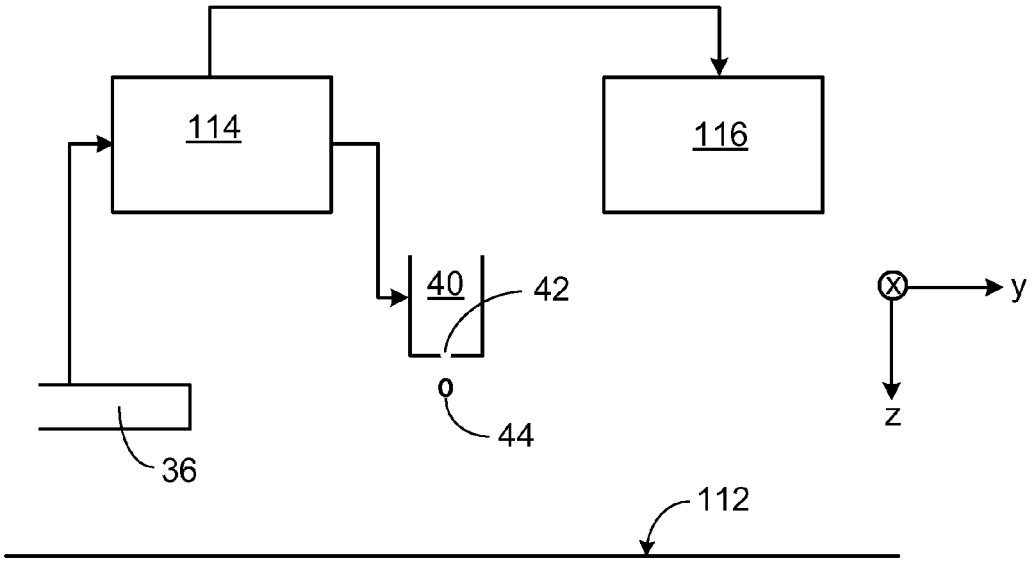
FIGS. 5A and 5B are block diagrams.

The jet performance measurements described above can also be done when the printer 10 of FIG. 1A or the printer 24 of FIG. 1B is executing printing jobs. Referring to FIG. 5A, the linescan camera 36 is kept stationary with respect to the printhead 40 of a step-and-repeat printer or a single pass printer that is executing printing jobs and monitors the ink droplets 44 jetted by the printhead 40 in a manner similar to that described in FIGS. 2, 2A and 2B. The images produced by the linescan camera 36 is processed in a processor 114 to produce measurements of the performance of the jets in printhead 40. The measurements can be delivered to a user interface 116, for example, a computer screen, for a user's review. The user can adjust a status or an aspect of the printhead, for example, stopping the printing job temporarily for maintenance of the printhead to improve the jet performance. The measurements can also be sent as a feedback to a control (not shown) of the printhead 40 so that adjustments, for example, change of an activation voltage associated one or more particular jets, can be done without interrupting the printing job to improve the jet performance in subsequent portions of the printing job, for example, printing of a subsequent page.

Figure 5B:
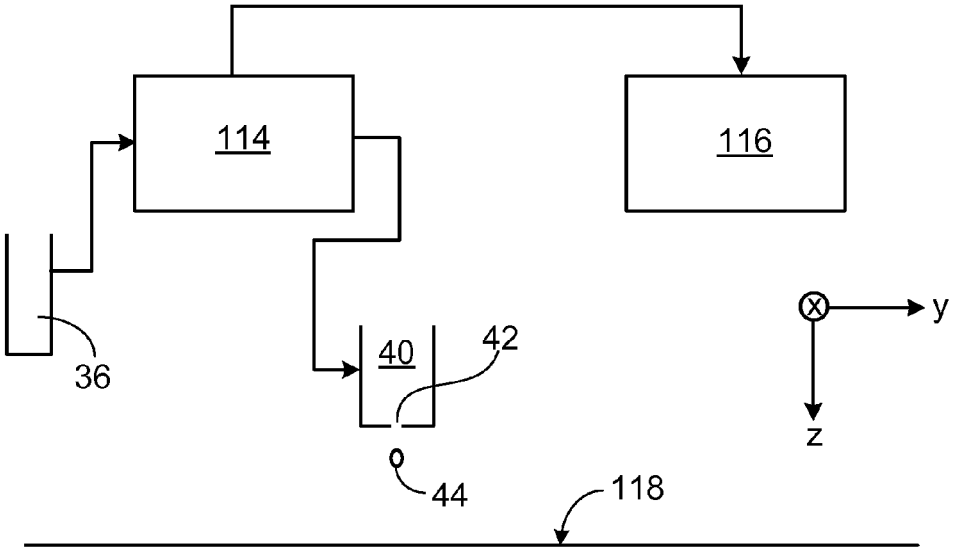

Referring to FIG. 5B, the linescan camera 36, processor 114, and user interface 116 of FIG. 5A can also be used to monitor the output of the printhead 40 on a substrate 118 to measure the performance of the jets in the printhead 40 as explained above. The printhead 36 is located in parallel with and behind (downstream of) the row of jets in printhead 40 along a process direction of the printing job (the substrate 118 moving in the y direction when the printhead 40 is in a single pass printer or the printhead 40 and the linescan camera 36 moving along the y direction when the printhead 40 is in a step-and-repeat printer) so that the linescan camera 36 generates images of the output substantially synchronously with the formation of the output by the printhead 40 on the substrate 118. Status or aspect correction or adjustment of the printhead 40 can be done without interrupting the printing process based on the measurements of the jet performance.

Although our examples use ink as the printing fluid, we use ink in a sense that includes a wide variety of printing and other fluids including non-image forming fluids. For example, three-dimensional model pastes can be selectively deposited to build models. Biological samples can be deposited on an analysis array.

We sometimes use the phrase imaging device to refer to a linescan camera and any other kind of device that can capture images.

Other embodiments are also within the scope of the following claims.

What is claimed is:

1. A system for use in ink jetting, the system comprising:
a printhead comprising a row of jets; and
an imaging device to capture images of portions of ink droplets that are jetted from a given jet of the row of jets at respective successive times, at least one of the images being of only less than an entire one of the ink droplets and at least two of the images being used to generate a composite image of a droplet.

2. The system of claim 1 in which the printhead includes at least 100 jets.

3. The system of claim 1 in which the printhead includes at least 200 jets.

4. The system of claim 1 in which the imaging device comprises a linescan camera.

5. The system of claim 1 in which the imaging device comprises linearly arranged pixels, each pixel having a resolution of about 2 μm to about 10 μm.

6. The system of claim 1 in which the imaging device comprises about 2000 pixels to about 12000 pixels.

7. The system of claim 1 in which the imaging device takes images at a maximum frequency of at least about 5 KHz.

8. The system of claim 1 in which the imaging device delivers the image information at a rate of about 30 mega-pixels/second to about 50 mega-pixels/second.

9. The system of claim 1 in which the composite image of a droplet is used to analyze at least one of a velocity of a droplet jetted from a corresponding jet, a size of the droplet, a shape of the droplet, a trajectory of the droplet, and distance between the droplet and its neighboring droplet perpendicular to a jetting direction.

10. The system of claim 1 in which the imaging device is located about 50 mm to about 200 mm from a trajectory of droplets jetted from the jets.

11. The system of claim 1 in which the imaging device is stationary relative to the printhead.

12. The system of claim 1 also including a device for processing images produced by the imaging device and evaluating a performance of the jets.

13. The system of claim 1 also including a control to automatically adjust an aspect of the printhead based on the performance of the jets during ink jetting.

14. The method of claim 1, comprising: using the captured images to infer information about characteristics of each of the droplets that is jetted from the ink jet.

15. The method of claim 14 in which the portions are about 1/10 to about 1/2.

16. A method for use in jetting ink comprising:
generating an image of a composite droplet based on at least two images of portions of ink droplets,
the image portions respectively capturing image information for portions of ink droplets that are jetted from a jet at successive time periods,
each image capturing image information for only less than an entire ink droplet.

17. The method of claim 16 in which the droplets are successive droplets jetted from the jet.

18. The method of claim 16 in which the images are generated at an imaging frequency different from a jetting frequency of the jet.

19. The method of claim 16 in which the images of portions of the droplets are composited along a jetting direction of the jet.

20. The method of claim 16 also including measuring a performance of the jet by calculating a velocity of the ink droplets based on the image of the composite droplet.

21. The method of claim 16 also including generating additional images of additional composite droplets and measuring a performance of the jet by calculating a trajectory of the ink droplets based on the image of the composite droplet and the additional images of the additional composite droplets.

22. The method of claim 16 also including measuring a performance of the jet based on the image information and adjusting an aspect of the jet based on the measured performance of the jet.

23. The method of claim 16 in which the jet is included in a printhead having more than 25 jets and the method also includes simultaneously generating an image of a composite droplet based on at least two image portions that respectively capture image information for portions of ink droplets jetted from each jet.

24. The method of claim 16 in which each image slice has a resolution of about 2 μm to about 10 μm.

25. A machine comprising:

a processor;

a storage device that stores a program for execution by the processor, the program comprising instructions for causing the processor to:

generate a composite droplet based on images of portions of ink droplets that are jetted from a given jet in a printhead at respective successive times, at least one of the images being of only less than an entire one of the ink droplets; and provide the composite droplet for analyzing performance of the given jet.

26. The machine of claim 25 in which the images capture different parts of the different droplets jetted from the given jet.

27. The machine of claim 25 in which the composite droplet is provided by displaying the composite droplet.

28. A non-transitory computer-readable medium having encoded thereon instructions for performing operations comprising:

generating a composite droplet based on images of portions of ink droplets each containing an image of only less than an entire droplet jetted from a given jet in a printhead, the images being of drops jetted at respective successive times; and providing the composite droplet for analyzing performance of the given jet.

29. The non-transitory computer-readable medium of claim 28 in which the composite droplet is provided by displaying the composite droplet.

30. The non-transitory computer-readable medium of claim 28 in which the image portions capture different parts of the different droplets jetted from the given jet.

* * * * *

UNITED STATES PATENT AND TRADEMARK OFFICE

CERTIFICATE OF CORRECTION

PATENT NO. : 8,579,397 B2
APPLICATION NO. : 12/204890
DATED : November 12, 2013
INVENTOR(S) : Barss et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1460 days.

Signed and Sealed this
Eighth Day of March, 2016

Michelle K. Lee

Michelle K. Lee
*Director of the United States Patent and Trademark Office*